US010244326B2

(12) United States Patent
Zheng et al.

(10) Patent No.: US 10,244,326 B2
(45) Date of Patent: Mar. 26, 2019

(54) MINIATURE SOUNDER

(71) Applicant: Goertek Inc., Shandong (CN)

(72) Inventors: Zedong Zheng, Shandong (CN); Zhenhua Liu, Shandong (CN); Yueguang Zhu, Shandong (CN); Hongtao Liu, Shandong (CN)

(73) Assignee: Goertek Inc., Weifang, Shandong (CN)

( * ) Notice: Subject to any disclaimer, the term of this patent is extended or adjusted under 35 U.S.C. 154(b) by 0 days.

(21) Appl. No.: 15/756,143

(22) PCT Filed: Dec. 10, 2015

(86) PCT No.: PCT/CN2015/096957

§ 371 (c)(1),
(2) Date: Feb. 28, 2018

(87) PCT Pub. No.: WO2017/035980

PCT Pub. Date: Mar. 9, 2017

(65) Prior Publication Data

US 2018/0255400 A1 Sep. 6, 2018

(30) Foreign Application Priority Data

Aug. 31, 2015 (CN) ..... 2015 2 0669159 U

(51) Int. Cl.
*H04R 3/00* (2006.01)
*H04R 1/02* (2006.01)
(Continued)

(52) U.S. Cl.
CPC ..... *H04R 9/06* (2013.01); *H04R 9/02* (2013.01); *H04R 31/00* (2013.01); *H04R 31/006* (2013.01);
(Continued)

(58) Field of Classification Search
CPC ..... H04R 2420/07; H04R 3/00; H04R 31/00; H04R 9/025; H04R 9/06
(Continued)

(56) References Cited

U.S. PATENT DOCUMENTS 8,340,329 B2 * 12/2012 Ogura ..... H01Q 1/44 343/720
2006/0056651 A1 * 3/2006 Yao ..... H04R 9/048 381/399
(Continued)

FOREIGN PATENT DOCUMENTS

CN 104159180 A 11/2014
CN 104822112 A 8/2015

OTHER PUBLICATIONS

International Searching Authority, International Search Report (ISR) and Written Opinion for International Application No. PCT/CN2015/096957, dated Mar. 29, 2016, 8 pages, State Intellectual Property of the P.R.C., China.

*Primary Examiner* — Khai N. Nguyen
(74) *Attorney, Agent, or Firm* — Alston & Bird LLP

(57) ABSTRACT

A miniature sounder is mounted in an electronic terminal and comprises a front cover and a housing that are combined together. A vibration system and a magnetic circuit system are accommodated in a space formed by the front cover and the housing in a surrounding manner. Two electrical connection members used for being electrically connected to the vibration system and the electronic terminal is disposed on the housing. An antenna of the electronic terminal is fixedly on the front cover, and the antenna is electrically connected to one of the two electrical connection members, and is electrically connected to a circuit of the electronic terminal by means of the electrical connection members. In the miniature sounder in the present invention, a wireless transceiver function is added to an original sounding function of
(Continued)

the miniature sounder, the structure of the electronic terminal is effectively simplified, the design difficulty and the assembly difficulty of the electronic terminal are reduced, the internal space of the electronic terminal is saved, which further promoting the electronic terminal to develop towards a light, thin and compact trend.

10 Claims, 2 Drawing Sheets

(51) Int. Cl.
*H04R 9/06* (2006.01)
*H04R 31/00* (2006.01)
*H04R 9/02* (2006.01)

(52) U.S. Cl.
CPC ..... *H04R 3/00* (2013.01); *H04R 9/025* (2013.01); *H04R 2420/07* (2013.01); *H04R 2499/11* (2013.01)

(58) Field of Classification Search
USPC ..... 381/111, 116, 117, 332, 334
See application file for complete search history.

(56) References Cited

U.S. PATENT DOCUMENTS

2010/0137019 A1* 6/2010 Pedersen ..... H01Q 1/50 455/550.1
2010/0290650 A1* 11/2010 Ogura ..... H01Q 1/44 381/190
2011/0274309 A1* 11/2011 Doh ..... H04R 9/047 381/398
2014/0029783 A1* 1/2014 Yang ..... H04R 1/02 381/395
2015/0122575 A1* 5/2015 Park ..... H04R 1/2811 181/182
2015/0126112 A1* 5/2015 Park ..... H02J 7/00 455/41.1
2018/0124499 A1* 5/2018 Li ..... H04R 1/24

* cited by examiner

MINIATURE SOUNDER

CROSS-REFERENCE TO RELATED APPLICATIONS

This application is a National Stage of International Application No. PCT/CN2015/096957, filed on Dec. 10, 2015, which claims priority to Chinese Patent Application No. 201520669159.2, filed on Aug. 31, 2015, both of which are hereby incorporated by reference in their entireties.

BACKGROUND

Technical Field

Embodiments of the present invention relate to the field of electro-acoustic products, and in particular, to a miniature sounder.

Description of Related Art

Embodiments of the present invention relates to the technical field of electroacoustic products, and in particular, to a miniature sounder applied to an electronic terminal with a wireless transceiving function.

As an important acoustic component in an electronic terminal, a miniature sounder for realizing conversion between an electrical signal and a sound signal is an energy conversion apparatus. A conventional miniature sounder generally comprises a housing and a front cover which are combined together; a vibration system and a magnetic circuit system are accommodated in the space formed by the housing and the front cover in a surrounding manner; and the housing is further combined with an electrical connector for electrically connecting the vibration system and a circuit of the electronic terminal.

With rapid development of the electronic technology and the wireless network technology, many electronic terminals have a wireless transceiving function, such as a Bluetooth function, a Wireless-Fidelity (Wi-Fi) function or other functions of a mobile phone or a tablet computer. However, it is required to arrange a metal wireless antenna in the electronic terminal to realize the above wireless transceiving function. In the electronic terminal, a miniature sounder is configured to receive an audio electrical signal and convert the same into a sound to be given out, and the wireless antenna is configured to connect to a network to receive and send data; and there is no correlation between the miniature sounder and the wireless antenna. The arrangement of the wireless antenna is greatly limited because the electronic terminal is becoming thinner and smaller. At present, the wireless antenna in the electronic terminal is generally arranged on a module housing of the miniature sounder or a housing of the electronic terminal. In this design, two contacts electrically connected to electrical connectors of the miniature sounder and a contact electrically connected to the antenna have to be arranged on a main circuit board of the electronic terminal. As a result, the electronic terminal is relatively complex in internal structure, difficult to design and large in occupied space, blocking thin and small development of the electronic terminal.

BRIEF SUMMARY

For the above defects, the technical problem to be solved by the present invention is to provide a miniature sounder which can not only convert an audio electrical signal into a sound signal but only have a wireless transceiving function, so that the inner structure of an electronic terminal is effectively simplified, and thin and small development of the electronic terminal is facilitated.

In order to solve the above technical problem, the present invention provides the following technical solutions.

A miniature sounder is mounted in an electronic terminal and comprises a front cover and a housing which are combined together; a vibration system and a magnetic circuit system are accommodated in the space enclosed by the front cover and the housing; two electrical connectors electrically connecting the vibration system and a circuit of the electronic terminal are arranged on the housing; and an antenna of the electronic terminal is fixed onto the front cover, electrically connected to one of the electrical connectors, and thus electrically connected to the circuit of the electronic terminal via the electrical connector.

The two electrical connectors are arranged on edges of the two opposite side walls of the housing, respectively; and a positioning block is arranged on one of the two side walls of the housing, and protrudes from the side surface of the housing.

The positioning block and the electrical connector electrically connected to the antenna are located at the same side of the housing; each of the electrical connector and the antenna is provided with a pad protruding from the side of the housing; the two pads and the positioning block are located at the same side of the housing, and the two pads are fixed onto the positioning block; the antenna and the electrical connector are electrically connected via the two pads.

The two pads are located at the side of the positioning block close to the front cover, and are stacked.

One end of each electrical connector is inserted into the housing and electrically connected to the vibration system, and the other end thereof is located at the outer side of the housing and electrically connected to the circuit of the electronic terminal; and the pad electrically connecting the electrical connector and the antenna is connected to the end of the electrical connector located inside the housing.

A sound hole is formed in the middle of the front cover, and the antenna is arranged around the sound hole.

The antenna is arranged at the outer side of the front cover.

The round antenna is provided with an opening, close to the pad of the antenna.

The antenna and the front cover are combined by an injection molding process or a laser process.

The electrical connectors are elastic sheets and combined with the housing by an injection molding process.

By adopting the above technical solutions, the present invention has the flowing beneficial effects.

The miniature sounder provided by the present invention is mounted in the electronic terminal and comprises the housing and the front cove which are combined together; the vibration system and the magnetic circuit system are accommodated in the space formed by the front cover and the housing in a surrounding manner; the two electrical connectors electrically connecting the vibration system and the circuit of the electronic terminal are arranged on the housing; and the antenna of the electronic terminal is fixed onto the front cover, and electrically connected to the circuit of the electronic terminal via one of the electrical connectors. In the miniature sounder provided by the present invention, the two electrical connectors together support transmission of an audio signal, and one of the electrical connectors can separately support transmission of an antenna signal. That is, the transmission of the audio signal on the circuit of the electronic terminal can be realized only through the two existing electrical connection contacts electrically connected to the sounder. Moreover, the transmission of the antenna signal is realized without additionally arranging another electrical connection contact for communicating the antenna signal, so that the internal structure of the electronic terminal is effectively simplified, the design difficulty is reduced, an assembling process is simplified. Meanwhile, the size of a main circuit board of the electronic terminal is reduced favorably, thereby facilitating the thin and small development of the electronic terminal.

As the positioning block is arranged on one of the two side walls of the housing on which the electrical connectors are arranged, and protrudes from the side surface of the housing, during assembling the electronic terminal, an assembler can know the electrical connector that is connected to the antenna without careful identification, avoiding reverse assembling of the miniature sounder. Therefore, the assembling difficulty is effectively reduced, the assembling efficiency is improved, and meanwhile, a qualified rate of finished electronic terminal products is increased.

The antenna is provided with the opening close to the pad of the antenna, that is, the antenna is a non-closed ring structure. Referring to FIG. 3, if the antenna is of a closed ring structure, the effective length of the antenna is only the length of the long side of the antenna; but for the antenna provided with the opening, the effective length of the antenna is the circumference thereof, so that the length of the antenna is effectively lengthened, the strength of the signal transmitted and received by the antenna is enhanced, and the performance of the antenna is improved, thereby improving the wireless function of the electronic terminal.

To sum up, the miniature sounder provided by the present invention solves the technical problems of a complex structure, difficult design and the like of the electronic terminal in the prior art, and additionally has the wireless transceiving function on the basis of an original sound generation function. For the electronic terminal, the structure is effectively simplified, the design and assembling difficulties are reduced, the internal space is saved, and the thin and thin and small development is facilitated.

Figure 1:
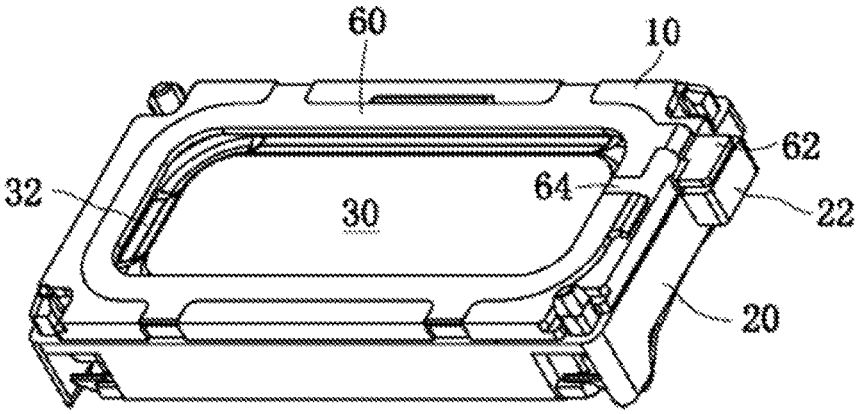
FIG. 1 is a schematically stereoscopic structure view of a miniature sounder provided by the present invention.

REFERENCE NUMERALS IN FIGS.

10: front cover; 12: sound hole; 20: housing; 22: positioning block; 30: dome; 32: vibration diaphragm; 34: voice coil; 340: voice coil lead; 40: magnetic conduction component; 50*a*: electrical connector; 50*b*: electrical connector: 52: pad of the electrical connector; 60: antenna; 62: pad of the antenna; and 64: opening.

DETAILED DESCRIPTION OF VARIOUS EMBODIMENTS

Embodiments of the present invention is further described below with reference to the accompanying drawings and embodiments.

In this description, the term "inner side" refers to the side close to the center of the miniature sounder; the term "outer side" refers to the side far from the center of the miniature sounder; the orientation "upper" means the vibration system direction, and the orientation "lower" means the magnetic circuit system direction.

Figure 2:
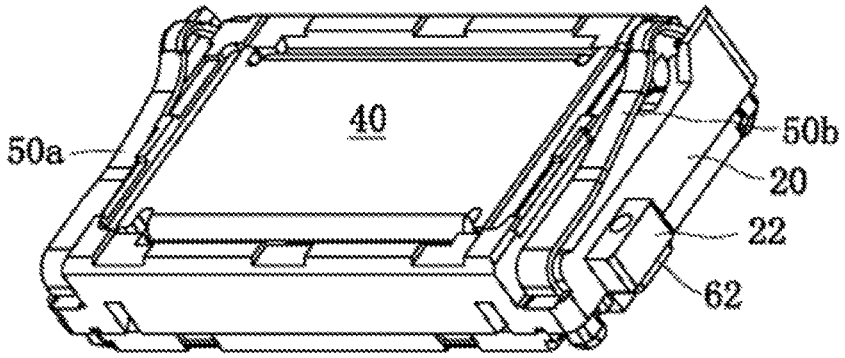
FIG. 2 is a rear view of FIG. 1.
Figure 4:
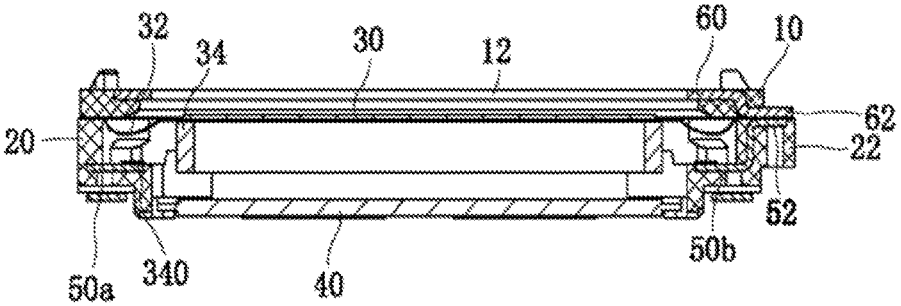
FIG. 4 is an enlarged section view of line A-A in FIG. 3.

As shown in FIGS. 1, 2 and 4, a miniature sounder is mounted in an electronic terminal, adopts a rectangular structure, and comprises a housing 20 and a front cover 10 which are combined together. The housing 20 is of a ring structure formed by four side walls and having two open ends; and a vibration system and a magnetic circuit system are accommodated in the space formed by the housing 20 and the front cover 10 in a surrounding manner. The two opposite sides of the end of the housing 20 not combined with the front cover 10 are fixed to electrical connectors 50*a* and 50*b*, respectively. The two electrical connectors 50*a* and 50*b* are elastic sheets and are injection-molded with the housing 20 for electrically connecting the vibration system and the circuit of the electronic terminal. One ends of the two electrical connectors 50*a* and 50*b* are inserted into the housing 20 and are electrically connected to the vibration system, and the other ends thereof are located at the outer side of the housing 20 and are electrically connected to the circuit of the electronic terminal.

Figure 3:
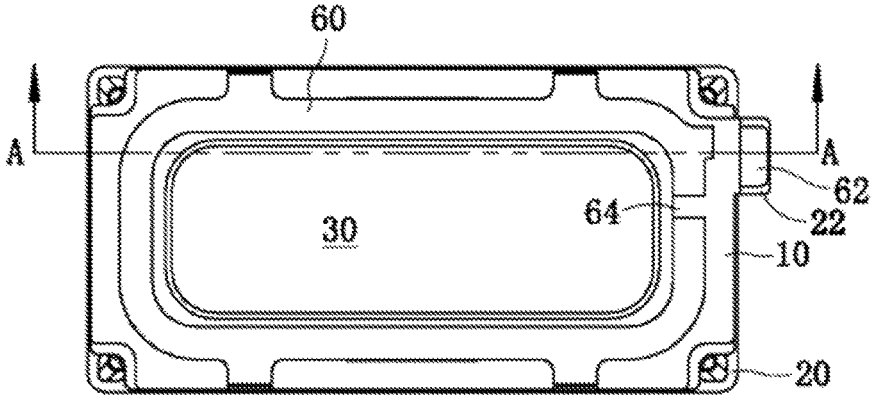
FIG. 3 is a top view of FIG. 1.

As shown in FIGS. 1, 3 and 4, a wireless antenna 60 of the electronic terminal is combined to the outer side of the front cover 10; a sound hole 12 is formed in the middle of the front cover 10; and the antenna 60 surrounds the sound hole 12. In the present embodiment, preferably, the antenna 60 is provided with an opening 64, that is, the antenna 60 is of a non-closed ring structure. An pad of the antenna 62 protruding from the side of the housing 20 is arranged at one side of the antenna 60, and is close to the opening 64. An pad of the electrical connector 52 protruding from the side of the housing 20 is arranged on the electrical connector 50*b* at the same side with the pad of the antenna 62, and is formed by first upwards stretching and then outwards stretching the side part of the end of the electrical connector 50*b* located in the housing 20. The corresponding surfaces of the pad of the antenna 62 and the pad of the electrical connector 52, which are corresponding to each other in the vertical direction and are stacked, are in contact with each other to realize electrical connection between the antenna 60 and the electrical connector 50*b*, so that the electrical connector 50*b* can communicate not only an audio signal but an antenna signal, and the antenna 60 can be electrically connected to the circuit of the electronic terminal via the electrical connector 50*b*. The antenna 60 is combined onto the front cover 10 by an injection molding process or a laser process.

As shown in FIGS. 1 and 4, a positioning block 22 is arranged on the side wall of the side of the housing 20 where the electrical connector 50*b* is mounted, adopts a rectangular structure, and protrudes from the side wall surface of this side of the housing 20. Both the pad of the antenna 62 and the pad of the electrical connector 52 are located at the upper side of the positioning block 22, namely, the side close to the front cover 10. The positioning block 22 is integrally formed with the housing 20. The surface of the pad of the electrical connector 52 in contact with the pad of the antenna 62 is flush with the upper surface of the positioning block 22 and is fixed onto the positioning block 22 by an injection molding process. The pad of the antenna 62 is fixed onto the pad of the electrical connector 52 by welding. The positioning block 22 bears and protects the pad of the electrical connector 52 and the pad of the antenna 62 to effectively ensure the stability and the reliability of the electrical connection therebetween, and prevents reverse assembling of the miniature sounder when assembling the electronic terminal. Thus, the assembling difficulty is effectively reduced, and the assembling efficiency is improved.

As shown in FIGS. 1, 2 and 4, the vibration system comprises a vibration diaphragm 32 whose edge is fixed to the front of both the housing 20 and the front cover 10. A dome 30 is fixed to the middle of the side of the vibration diaphragm 32 close to the front cover 10; and a voice coil 34 is fixed to the other side of the vibration diaphragm 32, and is formed by winding a voice coil wire. Two voice coil leads 340 are arranged at the two ends of the voice coil wire, respectively, and are electrically connected to one ends of the electrical connectors 50*a* and 50*b* located in the housing 20. The magnetic circuit system comprises a magnetic conduction component 40 fixed onto the lower end surface of the housing 20. An inner magnetic circuit and an outer magnetic circuit (not shown in the figures) are fixed at the inner side of the magnetic conduction component 40. The outer magnetic circuit surrounds the inner magnetic circuit; there is a magnetic gap between the outer magnetic circuit and the inner magnetic circuit; and the end part of the voice coil 34 is located in the magnetic gap. The voice coil 34 reciprocates vertically within the magnetic gap according to alternating audio electrical signals transmitted by the circuit of the electronic terminal. The vibration diaphragm 32 and the dome 30 vibrate along with the movement of the voice coil 34 to cause air to make a sound; and the sound is given out from the sound hole 12, thereby realizing the sound generation function of the miniature sounder.

In the present invention, the antenna of the electronic terminal is arranged on the front cover of the miniature sounder, and is electrically connected to one electrical connector, so that the sound generation function and the wireless transceiving function are realized only via two electrical connection contacts; and for the electronic terminal, the structure is effectively simplified, the design and assembling difficulties are reduced, meanwhile, the internal space is saved, and the thin and small development is facilitated.

The above embodiments of the present invention only illustrate the technical solutions of the present invention that the antenna of the electronic terminal is arranged on the front cover of the miniature sounder and the electrical connection between the antenna and the circuit of the electronic terminal is realized via one electrical connector of the miniature sounder. The structure of the miniature sounder is not limited to the rectangular structure described above, and may be a square, circular or oblong structure. The structure of the antenna is not limited to the above-mentioned rectangular ring structure, and may be designed into a linear or arcuate structure based on the shape of the front cover of the miniature sounder. The technical solutions of the present invention may be applied to any miniature sounder that needs to be mounted in an electronic terminal with a wireless transceiving function. Those skilled in the art can apply the technical solutions of the present invention to miniature sounders of other structures without any creative effort according to the description of the above embodiments. Therefore, no matter if the structures of both a miniature sounder and an antenna are the same as those described in the above embodiments or not, so long as the antenna of the electronic terminal is arranged on the front cover of the miniature sounder, and the antenna and the circuit of the electronic terminal are electrically connected via one electrical connector of the miniature sounder so as to simplify the structure of the electronic terminal and reduce the design difficulty and the size of the electronic terminal, such products shall fall within the protection scope of the present invention.

The present invention is not limited to the above specific embodiments, and various changes made by those skilled in the art without any creative effort based on the above concept shall fall within the protection scope of the present invention.

What is claimed is:

1. A miniature sounder, mounted in an electronic terminal and comprising:

a front cover and a housing which are combined together, wherein a vibration system and a magnetic circuit system are accommodated in the space formed by the front cover and the housing, and two electrical connectors electrically connecting the vibration system and a circuit of the electronic terminal are arranged on the housing, and wherein an antenna of the electronic terminal is (a) fixed onto the front cover, (b) electrically connected to one of the electrical connectors, and (c) thereby electrically connected to the circuit of the electronic terminal via the electrical connector.

2. The miniature sounder of claim 1, wherein the two electrical connectors are arranged on edges of the two opposite side walls of the housing, respectively; and a positioning block is arranged on one of the two side walls, and protrudes from the side surface of the housing.

3. The miniature sounder of claim 2, wherein (a) the positioning block and the electrical connector electrically connected to the antenna are located at the same side of the housing, (b) each of the electrical connector and the antenna is provided with a pad protruding from the side of the housing, (c) the two pads and the positioning block are located at the same side of the housing, and the two pads are fixed onto the positioning block, and (d) the antenna and the electrical connector are electrically connected via the two pads.

4. The miniature sounder of claim 3, wherein the two pads are located at the side of the positioning block close to the front cover, and are stacked.

5. The miniature sounder of claim 4, wherein (a) one end of each electrical connector is inserted into the housing and electrically connected to the vibration system, and the other end thereof is located at the outer side of the housing and electrically connected to the circuit of the electronic terminal, and (b) the pad electrically connecting the electrical connector and the antenna is connected to the end of the electrical connector located inside the housing.

6. The miniature sounder of claim 3, wherein a sound hole is formed in the middle of the front cover, and the antenna is arranged around the sound hole.

7. The miniature sounder of claim 6, wherein the antenna is arranged at the outer side of the front cover.

8. The miniature sounder of claim 7, wherein the antenna is a non-closed ring structure with an opening, close to the pad of the antenna.

9. The miniature sounder of claim 8, wherein the antenna and the front cover are combined by an injection molding process or a laser process.

10. The miniature sounder of claim 9, wherein the electrical connectors are elastic sheets and combined with the housing by an injection molding process.

* * * * *